US005165124A

United States Patent [19]

Li

[11] Patent Number: 5,165,124

[45] Date of Patent: Nov. 24, 1992

[54] LIFTING GATE CONTROL DEVICE FOR A BABY'S CRIB

[76] Inventor: Hsing Li, No. 17, Yung Hsing Street, Taichung, Taiwan

[21] Appl. No.: 821,043

[22] Filed: Jan. 16, 1992

[51] Int. Cl.[5] ..... A47D 7/02

[52] U.S. Cl. ..... 5/100; 292/DIG. 4

[58] Field of Search ..... 5/100, 428, 429, 93.1; 292/DIG. 4

[56] References Cited

U.S. PATENT DOCUMENTS

| | | | |
|---|---|---|---|
| 1,695,571 | 12/1928 | Baxter | 5/100 |
| 2,369,834 | 2/1945 | Lundin | 5/100 |
| 4,530,528 | 7/1985 | Shamie | 5/100 |

FOREIGN PATENT DOCUMENTS

| | | | |
|---|---|---|---|
| 872296 | 7/1961 | United Kingdom | 5/100 |

*Primary Examiner*—Alexander Grosz
*Attorney, Agent, or Firm*—Bacon & Thomas

[57] ABSTRACT

A lifting gate controlling device for controlling the front lifting gate of a baby's crib, comprising one pair of upper mounting bars respectively secured to the front two opposite corner posts of a baby's crib at an upper level, one pair of lower mounting bars respectively secured to said two opposite corner posts at a lower level, one pair of upper sliding blocks respectively movably mounted on said upper mounting bars to hold a transverse top rail of said lifting gate, and one pair of lower sliding blocks respectively movably mounted on said lower mounting bars to hold a transverse bottom rail of said lifting gate, wherein said upper mounting bars each has a V-shaped track incorporated in a P-shaped sliding track on a front face thereof for sliding either one of said upper sliding blocks by a sliding rod; said lower mounting bars each has a stop bolt at an upper end thereof to confine the upward movement of said lower sliding blocks. When the sliding rod of each upper sliding block is stopped at the V-shaped track, the front lifting gate is closed on the baby's crib. The front lifting gate is let down to open the baby's crib when the sliding rod of each upper sliding block is moved to a bottom terminal end of the P-shaped sliding track.

1 Claim, 5 Drawing Sheets

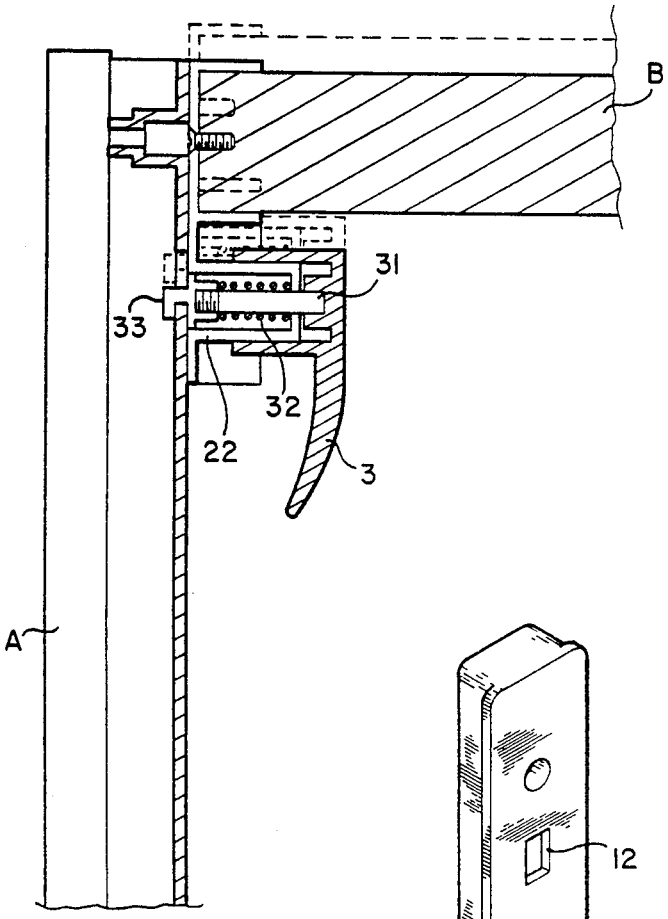
FIG. 1-A
(PRIOR ART)
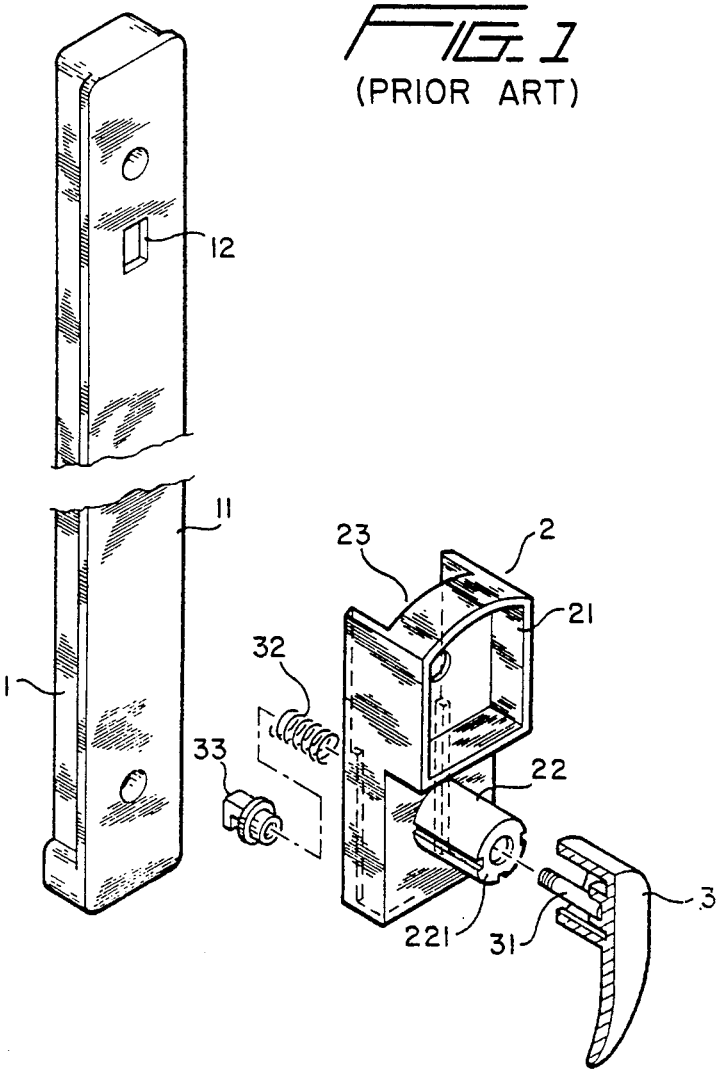
FIG. 1
(PRIOR ART)

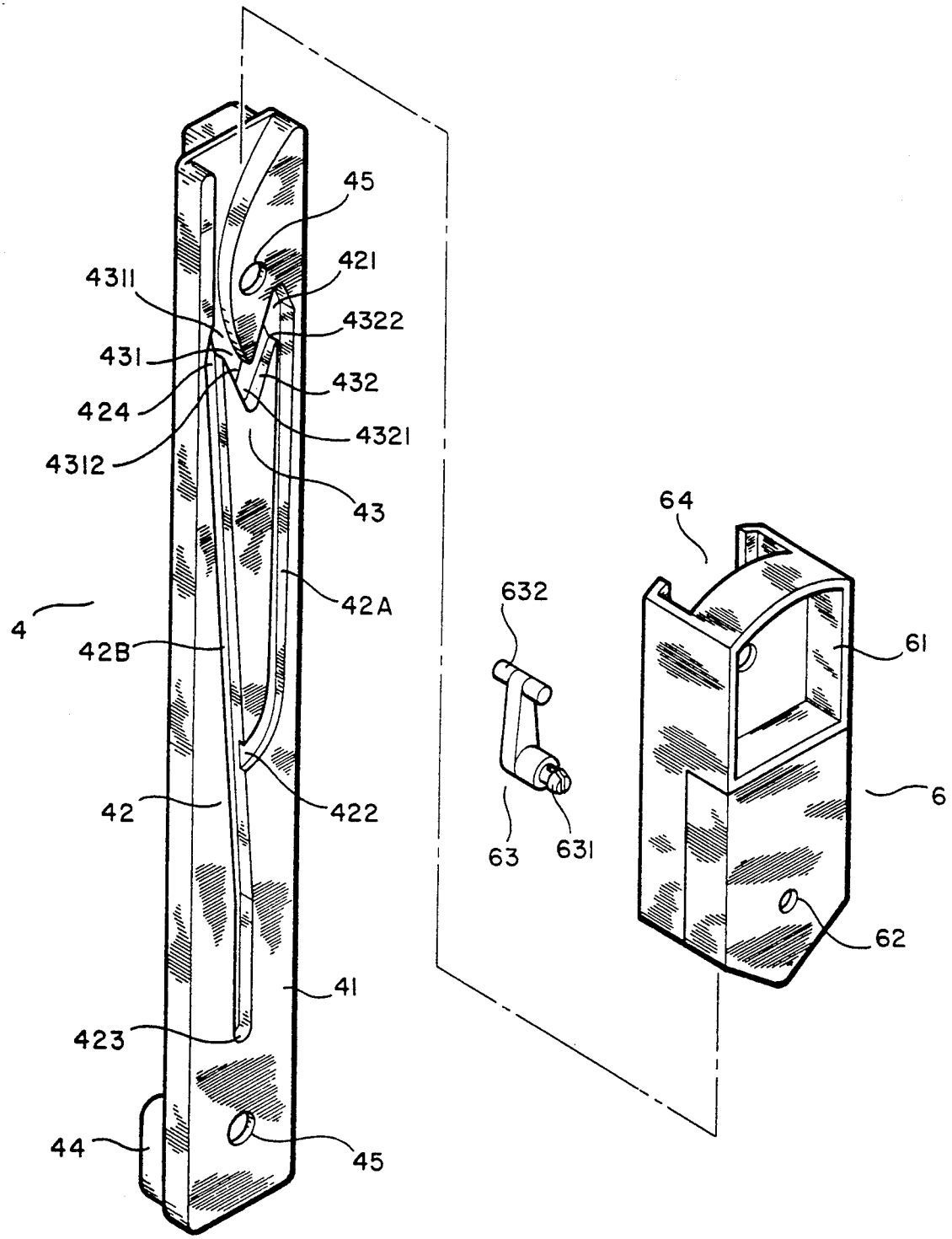
FIG. 2-A

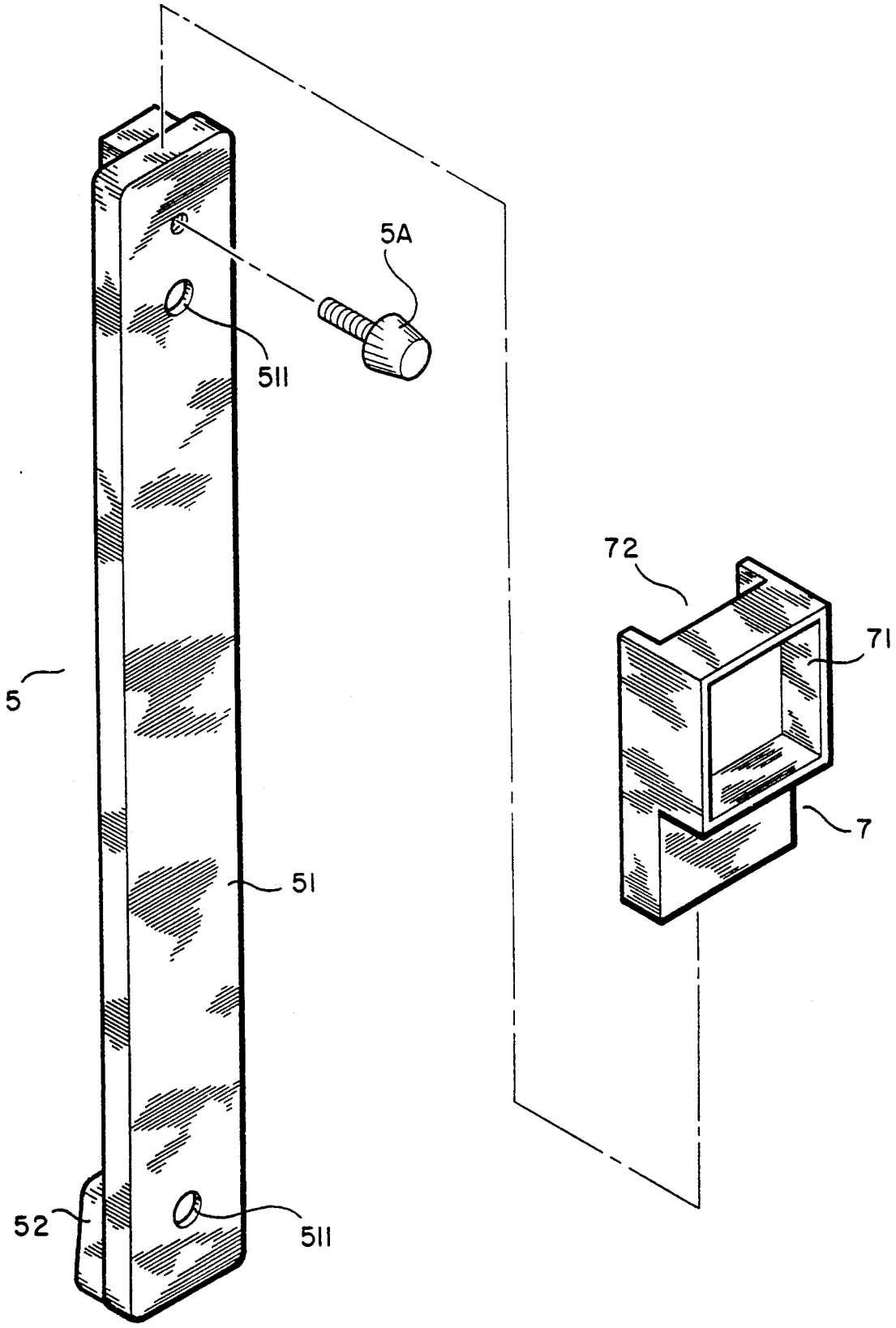
FIG. 2-B

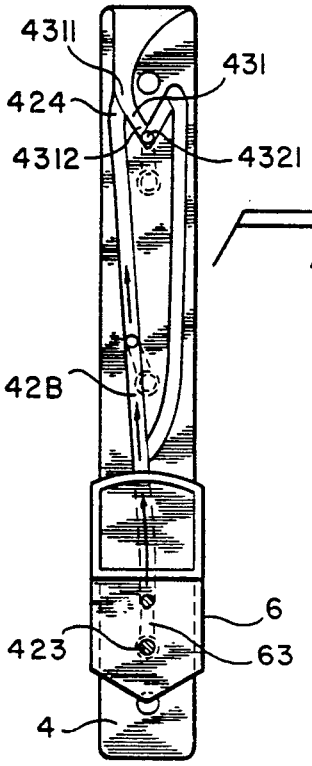
FIG. 4-B'
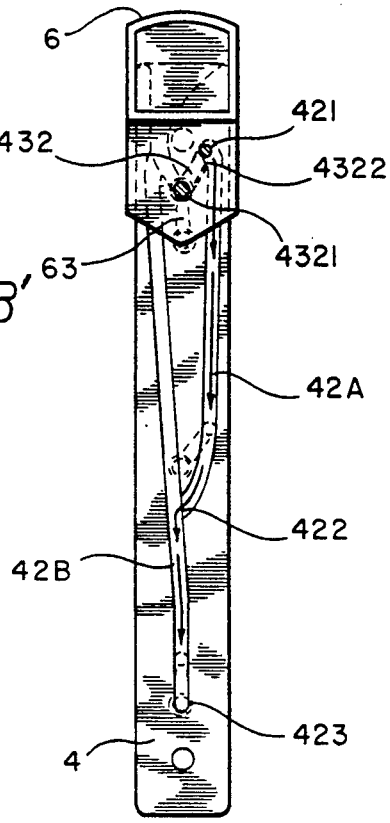
FIG. 4-A'
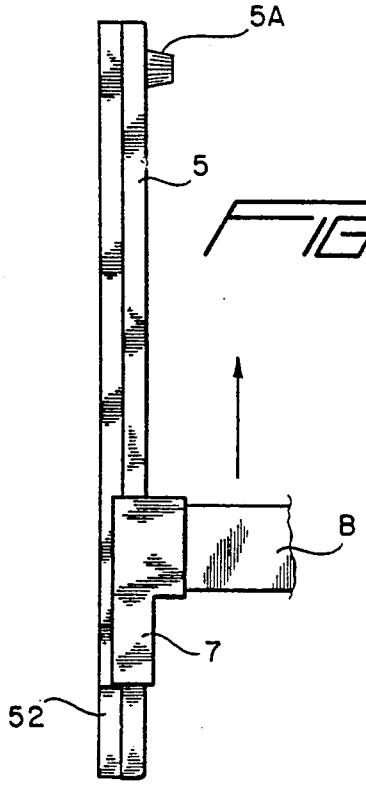
FIG. 4-B
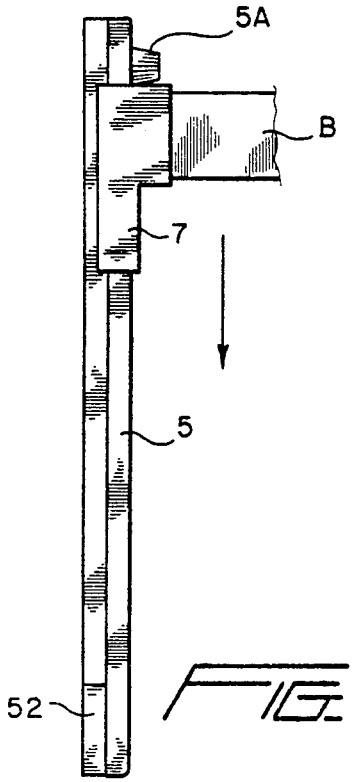
FIG. 4-A

LIFTING GATE CONTROL DEVICE FOR A BABY'S CRIB

BACKGROUND OF THE INVENTION

1. Field of the Invention

The present invention relates to a lifting gate control device and relates more particularly to such a lifting gate controlling device for securing the front lifting gate of a baby's crib in an upper limit position or permitting it to be moved down for putting a baby on a bed plate inside said baby's crib.

2. Description of Prior Art

A baby's crib is generally comprised of a bed plate with high sides. Conventionally, the high sides of a baby's crib are not collapsible. Therefore, it is not convenient to put a baby on the bed plate inside a baby's crib or carry the baby out of a baby's crib. In order to eliminate this problem, there is provided a baby's crib having a front lifting gate secured to two corner posts at one side thereof by two controlling devices which permit the front lifting gate to be moved down for conveniently putting a baby onto the bed plate therein. The lifting gate controlling device, as illustrated in FIGS. 1 and 1-A, is generally comprised of a mounting bar (1) attached to either corner post (A) of a baby's crib which mounting bar (1) has a locating slot (12) on a sliding surface (11) thereof; a slide (2) movably mounted on said sliding surface (11) which has a fastening hole (21) for holding the top rail (B) of the front gate of the baby's crib, a circular rod (22) at right angle below said fastening hole (21) and a sliding way (23) on a back wall thereof; and a rotary handle (3) which has a unitary screw rod (31) inserted into a through hole (221) on said circular rod (22) and connected to a L-shaped lock bolt (33), and a compression spring (32) sleeved on said unitary screw rod (31) and retained between said L-shaped lock bolt (33). By rotating the rotary handle (3) and pulling it outwards, the front gate of the baby's crib can be let down. Because two lifting gate controlling devices must be symmetrically mounted on the two corner posts at the front of a baby's crib to simultaneously hold the top rail of the front gate, the two handles (3) of the two lifting gate controlling devices must be simultaneously rotated and pulled outwards so that the two L-shaped lock bolts (33) of the two lifting gate controlling devices can be disconnected from the locating slots (12) of the two mounting bars (1). When one has a baby on one's arms, it is difficult to simultaneously unlocking two lifting gate controlling devices. Because much labor effort is required to rotate the handle (3) of each lifting gate controlling device and pull it outwards, a baby's crib may be shaken and caused to displace while unlocking the lifting gate controlling devices. Therefore, a baby's crib shall be stopped at a corner area or closely set against a wall inside a building. Further, the L-shaped lock bolt (33) may engage into the locating slot (12) easily when the slide (2) is moved downwards from the top.

SUMMARY OF THE INVENTION

The present invention has been accomplished to eliminate the aforesaid problems. According to one aspect of the present invention, there is provided a lifting gate controlling device for controlling the front lifting gate of a baby's crib, which is generally comprised of one pair of upper mounting bars and one pair of lower mounting bars respectively connected to the two front corner posts of a baby's crib at two levels for holding the top and bottom transverse rails of a lifting gate by one pair of upper sliding blocks and one pair of lower sliding blocks respectively. The upper mounting bars each has a V-shaped track incorporated in a P-shaped sliding track on a front face thereof for sliding either one of the upper sliding blocks by a sliding rod. When the sliding rod of each upper sliding block is stopped at the V-shaped track, the front lifting gate is closed on the baby's crib. The front lifting gate is let down to open the baby's crib when the sliding rod of each upper sliding block is moved to a bottom terminal end on the P-shaped sliding track. According to another aspect of the present invention, the lower mounting bars each has a stop bolt at an upper end thereof which confines the upward movement of the lower sliding blocks within a front sliding face thereof so that the lifting gate does not disconnect from the baby's crib when it is lifted.

BRIEF DESCRIPTION OF THE DRAWINGS

The foregoing and other objects, features and advantages of the present invention will be best understood from the following description, the appended claims and the accompanying drawings in which:

FIG. 1 is an exploded perspective view of a prior art lifting gate controlling device;

FIG. 1-A is a sectional assembly view of the prior art lifting gate controlling device;

FIG. 2-A is an exploded perspective view of an upper mounting bar and an upper sliding block according to the present invention;

FIG. 2-B is an exploded perspective view of a lower mounting bar and a lower sliding block according to the present invention;

FIG. 4-A are schematic drawings showing the down stroke of the upper and lower sliding blocks to let down the front lifting gate of a baby's crib; and FIG. 4-B are schematic drawings showing that the up stroke of the upper and lower sliding blocks to lift the front lifting gate of the baby's crib.

DETAILED DESCRIPTION OF THE PREFERRED EMBODIMENT

Figure 3:
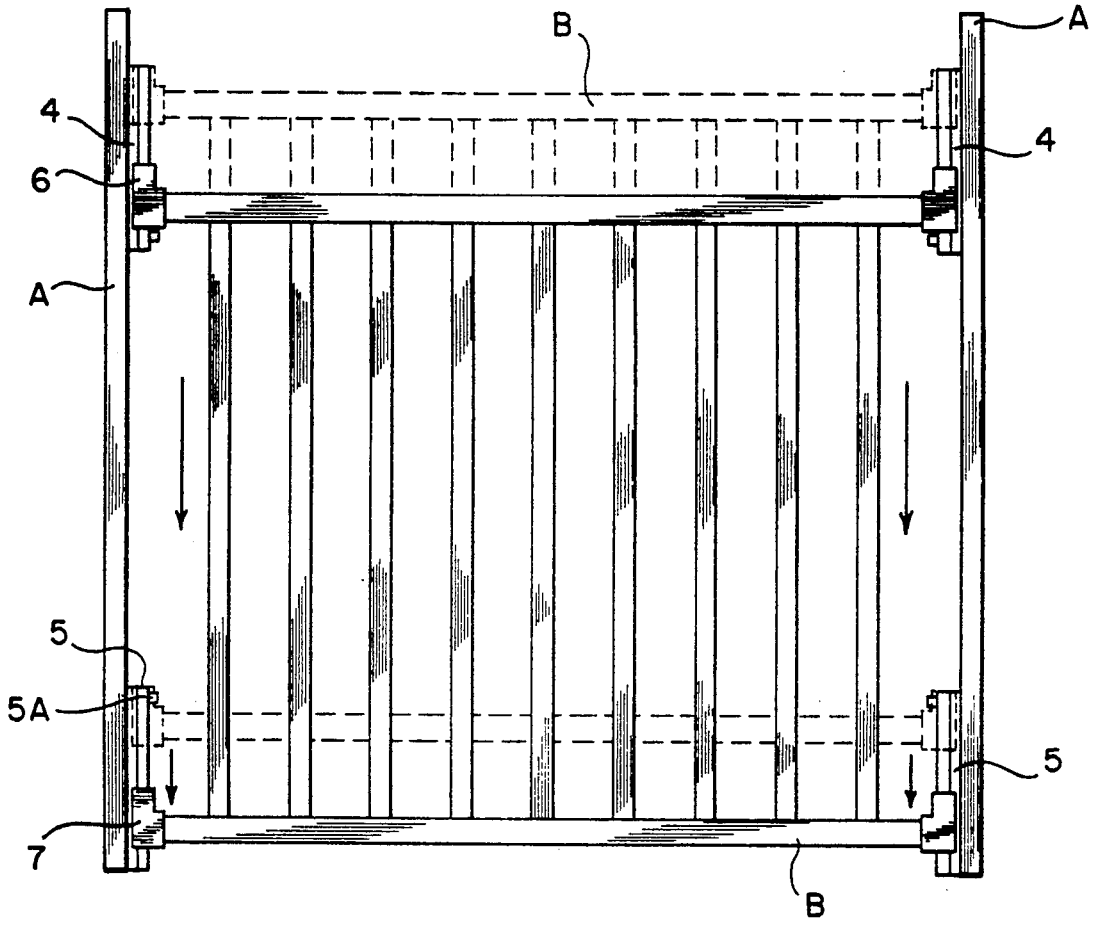
FIG. 3 is a plan view showing that a lifting gate which is secured to two corner posts of a baby's crib by a lifting gate controlling device of the present invention can be conveniently let down.

Referring to FIGS. 2-A, 2-B and 3, one pair of upper mounting bars 4 and one pair of lower mounting bars 5 are respectively attached to two opposite corner posts A at the front side of a baby's crib for movably holding a lifting gate B by on pair of upper sliding blocks 6 and one pair of lower sliding blocks 7.

Referring to FIG. 2-A again, each upper sliding block 6 is respectively secured to each upper mounting bar 4 for holding the lifting gate B. Each upper mounting bar 4 has a substantially P-shaped sliding track 42 on a front face 41 thereof, a stop block 44 on a back face thereof at one end, two bolt holes 45 at two opposite ends respectively fastened to a corner post of a baby's crib at two opposite locations by screws. The sliding track 42 includes a V-shaped track 43 at one end which forms into two sloping edges 431, 432, a straight track 42B extending from one end of the V-shaped track 43 and terminated into a terminal end 423, a curved track 42A extending from an opposite end of the V-shaped track 43 and terminated into the straight track 42B at a junction 422. Each upper sliding block 6 has a locating hole 61 at one side for holding either end of the transverse top rail of the lifting gate B, a through hole 62 at a lower end thereof for fastening a split connecting end 631 of a sliding rod 63, and a sliding groove 64 on a back face thereof in longitudinal direction mounted on the front face 41 and moved to slide thereon, wherein the sliding rod 63 has an opposite end 632 inserted in the P-shaped sliding track 42 and moved to slide therein.

Referring to FIG. 2-B again, each lower sliding block 7 is respectively secured to each lower mounting bar 5 for holding the lifting gate B. Each lower mounting bar 5 has two bolt holes 511 on a front face 51 thereof at two opposite ends respectively fastened to a corner post of a baby's crib at two opposite locations by screws, a bolt 5A on the front face 51 at one end, and a stop block 52 on a back face thereof at an opposite end. Each lower sliding block 7 has a locating hole 71 at one side for holding either end of the bottom transverse rail of the lifting gate B, and a sliding groove 72 on a back face thereof mounted on the front face 51 and moved to slide thereon.

Referring to FIG. 4-A and seeing FIG. 3 again, the end 632 of the sliding rod 63 is moved from a lower end 4321 of the sloping edge 432 through a top end 4322 thereof into the curved track 42A via a turning point 421, then, moved through the junction 422 into the straight track 42B, and then, moved to the terminal end 423 permitting the corresponding upper sliding block 6 to be stopped at the stop block 44 of the corresponding upper mounting bar 4. At the same time, the matched lower sliding block 7 is stopped at the stop block 52 of the corresponding lower mounting bar 5. Therefore, the lifting gate B is let down (the real lines in FIG. 3).

Referring to FIG. 4-B and seeing FIG. 3 again, the end 632 of the sliding rod 63 is moved from the terminal end 423 through the straight track 42B, a turning point 424, into an upper end 4311 and a lower end 4312 of the sloping edge 431, and then, returned to the lower end 4321 of the sloping edge 432. Therefore, the lifting gate B is moved back to its original position (see the dotted lines in FIG. 3). When the lifting gate B is lifted, the lower sliding block 7 on each lower mounting bar 5 will be finally stopped by the bolt 5A, and therefore, the lifting gate B does not disconnect from the corner posts A.

I claim:

1. A lifting gate controlling device for securing a front gate of a baby's crib to two opposite corner posts at a front side thereof permitting it to be retained at a closed position or let down to an opened position, the device comprising one pair of upper mounting bars respectively secured to said two opposite corner posts at an upper level, one pair of lower mounting bars respectively secured to said two opposite corner posts at a lower level, one pair of upper sliding blocks respectively movably mounted on said upper mounting bars to hold a transverse top rail of said lifting gate, and one pair of lower sliding blocks respectively movably mounted on said lower mounting bars to hold a transverse bottom rail of said lifting gate, wherein said upper mounting bars each has a P-shaped sliding track on a front face thereof for sliding either one of said upper sliding blocks by a sliding rod, said P-shaped sliding track including a V-shaped track forming into two opposed sloping edges; said lower mounting bars each having a stop bolt at an upper end thereof to confine the upward movement of said lower sliding blocks.

* * * * *